US005465704A

United States Patent [19]

Kohl

[11] Patent Number: 5,465,704

[45] Date of Patent: Nov. 14, 1995

[54] DISC LAUNCHER

[75] Inventor: William K. Kohl, Haiku, Hi.

[73] Assignee: Testy Putts Corporation, Haiku, Hi.

[21] Appl. No.: 218,119

[22] Filed: Mar. 25, 1994

[51] Int. Cl.[6] ..... F41B 3/00; F41J 9/18

[52] U.S. Cl. ..... 124/5; 124/42

[58] Field of Search ..... 124/4, 5, 6, 42, 124/46

[56] References Cited

U.S. PATENT DOCUMENTS

| | | | |
|---|---|---|---|
| 1,607,874 | 11/1926 | Darton | 124/5 |
| 2,481,522 | 9/1949 | Livermon | 124/5 |
| 2,493,245 | 1/1950 | Hansen | 124/5 |
| 2,586,547 | 2/1952 | Marley | 124/5 |
| 2,994,313 | 8/1961 | Grahn | 124/6 |
| 4,157,828 | 6/1979 | Cosmopulos | 273/96 R |
| 4,347,828 | 9/1982 | Bridgeman | 124/5 |
| 4,548,413 | 10/1985 | David | 124/5 X |
| 4,677,961 | 7/1987 | Allison | 124/5 |
| 4,730,595 | 3/1988 | Glass | 124/5 |
| 4,872,688 | 10/1989 | Galvin | 273/326 |
| 4,974,574 | 12/1990 | Cutlip | 124/5 |
| 4,984,556 | 1/1991 | Glass | 124/5 |
| 5,181,500 | 1/1993 | Chamberland | 124/5 |
| 5,232,226 | 8/1993 | Glickson | 273/323 |

*Primary Examiner*—John A. Ricci

*Attorney, Agent, or Firm*—Kane, Dalsimer, Sullivan, Kurucz, Levy, Eisele and Richard

[57] ABSTRACT

A rigid, hand-held disc launcher for launching small cardboard discs, having a handle (1) attached to a head (2) which is curved in a substantially semi-circular arc of approximately 180°. An open-ended slot runs through the entire arc of the curved head with one slot opening (4) in the head being located near the handle and the other slot opening (5) being located at the other end of the head. A disc inserted in the slot opening near the handle is launched from the other slot opening when accelerated by centrifugal forces caused by the disc launcher being swung forward by the handle.

19 Claims, 3 Drawing Sheets

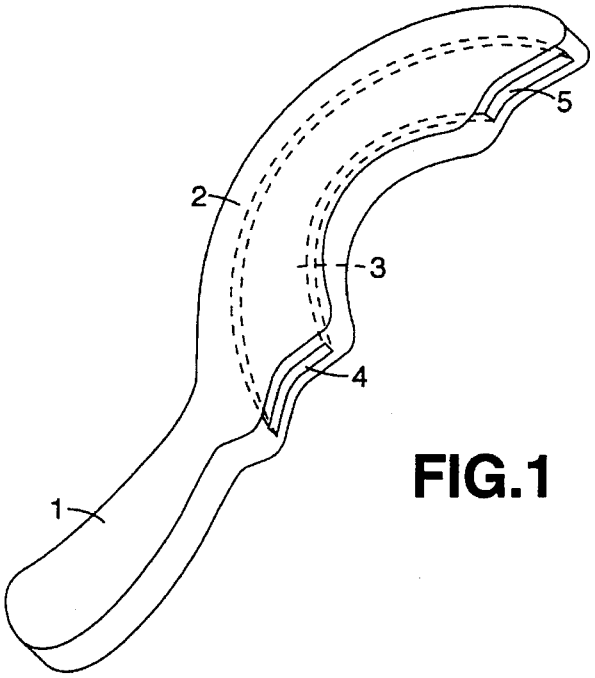
FIG.1
FIG.2
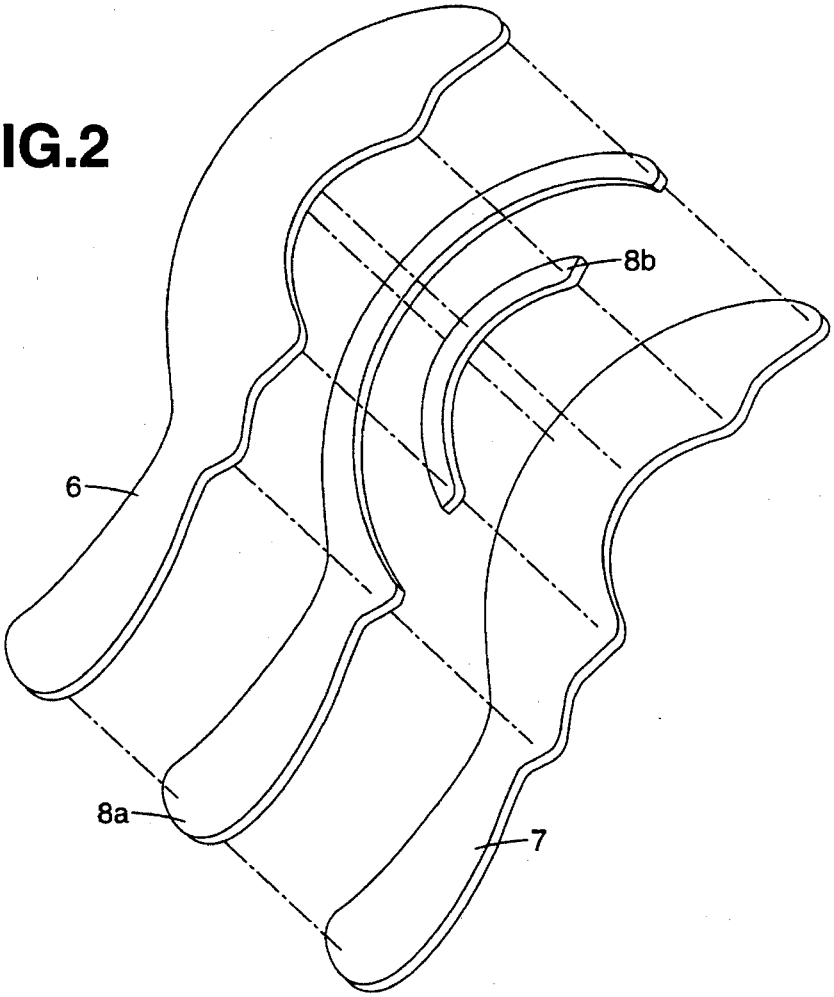

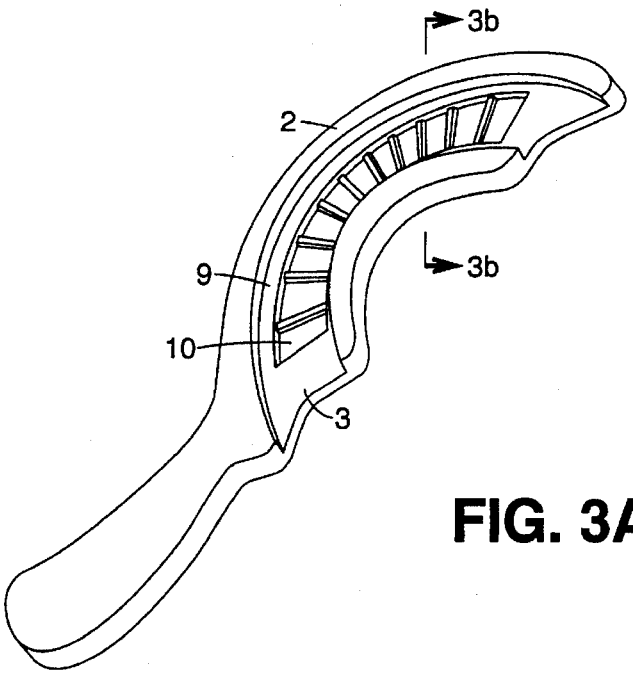
FIG. 3A
FIG. 3B
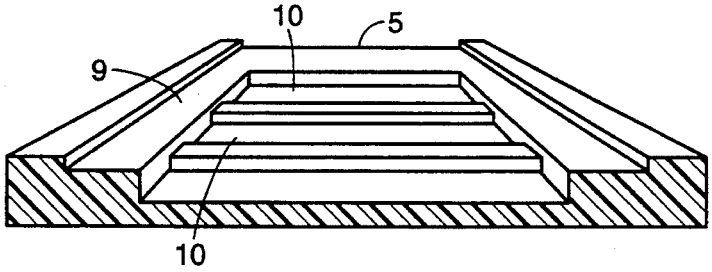
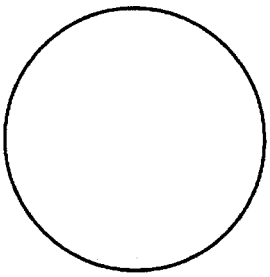
FIG. 4A
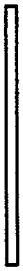
FIG. 4B

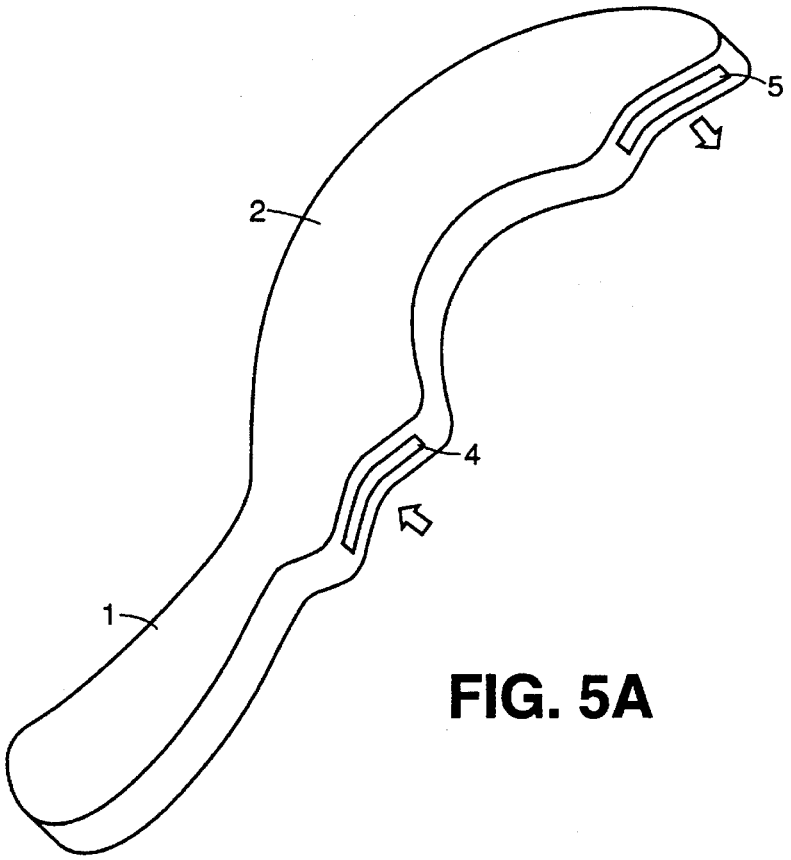
FIG. 5A
FIG. 5B
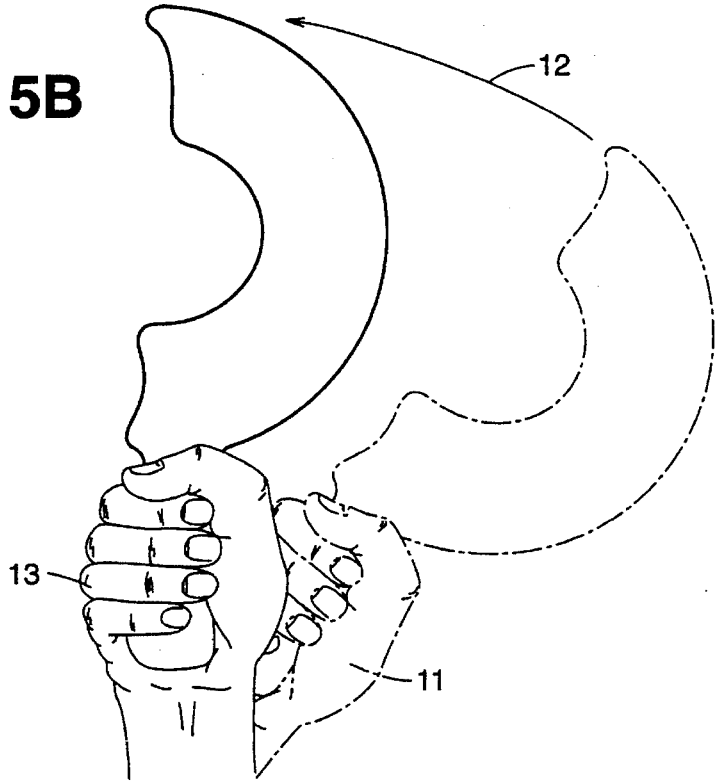

DISC LAUNCHER

BACKGROUND

1. Field of Invention

This invention relates to mechanical guns and projectors, specifically to disc launchers.

2. Discussion of Prior Art

Prior to the contemporary popular appeal of new cardboard milk caps as well as antique milk caps as collectible items there has been little or no occasion for the creation of a launcher for small cardboard discs. Relatively inexpensive, milk caps now generate considerable interest among children as well as businesses that see milk caps with their logos as promotional material. No. U.S. patents have been issued for launchers designed to utilize small cardboard discs, though inventors have created devices to launch the popular "Frisbee" type of flying disc.

U.S. Pat. No. 5,232,226 to Glickson Aug. 3, 1993; U.S. Pat. No. 5,181,500 to Chamberland Jan. 26, 1993; U.S. Pat. No. 4,984,556 to Glass Jan. 15, 1991 and U.S. Pat. No. 4,730,595 Mar. 15, 1988 also to Glass; U.S. Pat. No. 4,872,688 to Galvin Oct. 10, 1989; U.S. Pat. No. 4,347,828 to Bridgeman Sep. 7, 1982; and U.S. Pat. No. 4,157,828 to Cosmopulos Jun. 12, 1979 are all such flying disc launchers. U.S. Pat. No. 4,974,574 to Cutlip Dec. 4, 1990 is a multiple launcher for the popular plastic flying disc.

The launchers of Glickson, Chamberland, Galvin, and Cosmopulos are described as disc catchers as well and the Cosmopulos device is large and requires two hands to hold.

U.S. Pat. No. 2,493,245 to Hansen Jan. 3, 1950 and U.S. Pat. No. 2,481,522 to Livermon Feb. 28, 1945 as well as the afore mentioned Bridgeman, Glickson, and Glass launchers are complex devices with multiple functioning parts such as pivots, arms, clamps, hinges, and/or multiple handles.

Galvin, Glass, and Cutlip also describe their devices as being in some way flexible or having flexible members.

OBJECTS AND ADVANTAGES

Accordingly, besides the objects and advantages of the disc launcher described herein, several objects and advantages of the present invention are:

(a) to provide a disc launcher that utilizes a commonly available, lightweight, and relatively inexpensive cardboard milk cap as a missile, (b) to provide a disc launcher whose ejective force and range are determined by the physical strength and skill of the user so to limit its capacity for harm among children, (c) to provide a disc launcher that would not launch common coins, (d) to provide a disc launcher with no moving or flexing parts, and (e) to provide a disc launcher that is possible to manufacture by both small scale and mass production methods.

Further objects and advantages are to provide a disc launcher that is itself lightweight and of simple, inexpensive, and durable construction. Still further objects and advantages will become apparent from a consideration of the ensuing description and drawings.

DRAWING FIGURES

FIG. 1 shows a perspective view of a basic version of my disc launcher.

FIG. 2 shows an exploded view of the disc launcher of FIG. 1.

FIG. 3*a* shows the preferred embodiment of my disc launcher.

FIG. 3*b* shows a detail of the slot in the preferred embodiment of my disc launcher.

FIGS. 4*a* and 4*b* show a top plain view and side view of a respectively typical disc.

FIGS. 5*a* and 5*b* show the operation of my disc launcher.

REFERENCE NUMERALS IN DRAWINGS

1 handle
2 head
3 slot
4 slot opening
5 slot opening
6 top-side piece
7 bottom side piece
8*a* spacer
8*b* spacer
9 track
10 trough
11 cocked position
12 direction of pivot
13 launch position

DESCRIPTION

FIGS. 1 to 3*b*

A basic version of my disc launcher in accordance with the invention is shown in FIG. 1 and FIG. 2. The disc launcher is constructed of pieces cut from approximately ⅛ inch thick rigid planar material such as chipboard but not restricted to this material. FIG. 1 shows a handle 1 attached to a head 2 with a slot 3 in the head with a slot opening 4 and a slot opening 5. Head 2 is curved in a substantially semi-circular arc of approximately 180°. Slot 3 runs the entire length of head 2, slot opening 4 being located at the end of the head nearest handle 1 and slot opening 5 being located at the other end of the head.

Slot 3 is created when, as indicated in FIG. 2, spacer 8*a* and spacer 8*b* are sandwiched between top-side piece 6 and bottom-side piece 7 and glued in place. Spacer 8*a* completes the structure of handle 1 and forms the outer curved wall of slot 3 and spacer 8*b* forms the inner curved wall of the slot. Spacers 8*a* and 8*b* are positioned approximately 5 cm apart.

Created by the assembly described above, slot 3 has a rectangular cross-sectional shape and measures roughly 0.35 cm on the minor walls by 5.0 cm on the major walls. The radius of the arc of the curved head is roughly 11.5 cm measured to the outside of the head. The disc launcher is typically 38.5 cm long including handle 1 and roughly 1.0 cm in thickness.

FIG. 3*a* shows the preferred embodiment of my disc launcher in which case the disc launcher is made of molded rigid plastic formed in complementary halves which are glued together. FIG. 3*a* shows one of the halves. The spacers 8*a* and 8*b* used to create slot 3 in the basic version in FIGS. 1 and 2 are formed in the mold as part of the complementary halves of the preferred embodiment and are thus eliminated as separate pieces. Additionally, slot 3 in FIG. 3*a* incorporates tracks 9 along the major walls of the slot and a series of troughs 10 recessed slightly below tracks 9 and set radially around the slot. A detail of the inner surfaces of slot 3 in the preferred embodiment is shown in FIG. 3*b*. Tracks 9 and troughs 10 can be clearly seen in FIG. 3*b* and slot opening 5 is shown at the rear of the detail. The curve of slot 3 as shown in FIG. 3*a* has been straightened in FIG. 3*b* to simplify the drawing.

OPERATION

FIGS. 4*a* to 5*b*

FIGS. 4*a* and 4*b* show a typical cardboard disc known commonly in paper trade journals as a milk cap but referred to as a disc. FIG. 4*a* shows a view of a disc from either identical top or bottom face. FIG. 4*b* shows a disc from an oblate view as it would be inserted into slot opening 4 (FIG. 5*a*). FIGS. 4*a* and 4*b* are provided for information and should not be construed as including the disc itself.

The manner of launching the above described disc with my disc launcher is to hold handle 1 in either the left hand or right hand as shown in FIG. 5*b*. The disc launcher is held approximately level and at the side of the body, slot openings 4 and 5 of head 2 facing forward. This body position is not shown. A disc is inserted into slot opening 4 (FIG. 5*a*). The disc launcher is held with the hand cocked 11 slightly back as shown in FIG. 5*b* and then rapidly pivoted forward 12 by a snapping motion of the wrist. This snapping motion of the wrist generates centrifugal forces within the curve of the disc launcher, rolling the disc along the outer curved minor wall of slot 3. The disc accelerates as it travels through the slot and is launched from slot opening 5 (FIG. 5*a*) as the user's hand reaches launch position 13 (FIG. 5*b*).

In the preferred embodiment in FIGS. 3*a* and 3*b* the disc travels as described above and is confined to the space between the major walls of slot 3 by tracks 9. Tracks 9 are set at just sufficient width as to facilitate passage of the appropriate disc but are wide enough apart so that common coins inserted into the launcher will not contact both tracks 9 on either major wall of slot 3, but will instead tend to catch in the recessed series of troughs 10 and thereupon not accelerate sufficiently for launching. The common coins would require shaking to dislodge.

CONCLUSION, RAMIFICATIONS, AND SCOPE OF INVENTION

Accordingly, the reader will see that the disc launcher of this invention will easily and effectively launch the described cardboard disc. Furthermore, the disc launcher has the further advantages in that is it will not launch common coins; it has no moving, loose, or flexible parts and is therefore easy to assemble in a basic version or by mass-production methods in the preferred embodiment.

Additionally, its ejective force is determined by the user's physical strength as opposed to a triggering mechanism of some complex design so that the disc launcher's capacity for harm among small children is therefore reduced.

While my above description contains many specificities, these should not be construed as limitations of the scope of the invention, but rather as illustrations of one presently preferred embodiment thereof. Many other variations are possible. For example, the disc launcher can have two or more adjacent slots sandwiched into the head to simultaneously launch multiple discs. The size of the slot can be altered to accomodate a differently sized disc.

Accordingly, the scope of the invention should be determined by the appended claims and their legal equivalents, rather than by the embodiments illustrated.

I claim:

1. A hand-held disc launching apparatus comprising a handle and a head having a proximal end and a distal end, said handle being attached adjacent to said proximal end of said head, said head having means for accelerating and launching a disc of a predetermined size, said means for accelerating and launching having a curved slot therein which runs through said head from said proximal end to said distal end, said slot having an opening at both ends and having a cross-sectional shape to receive the disc in said opening in said proximal end of said head, said slot being configured so that launching of said disc from said opening in said distal end of said head is accompanied by acceleration of said disc through said slot by centrifugal force caused by said apparatus being swung forward by said handle, said head is curved in the shape of a substantially semi-circular arc of approximately 180°.

said slot has a predetermined rectangular cross-sectional shape, said means for accelerating and launching includes a first wall and a second opposite wall defining said rectangular slot and a pair of concentric semi-circular tracks of predetermined spacing on each wall of said rectangular slot.

2. The apparatus of claim 1 wherein said apparatus is formed of pieces of predetermined size and shape cut from rigid planar material, said pieces being joined together with adhesive so as to create said accelerating and launching means.

3. The apparatus of claim 1 wherein said apparatus is formed of molded rigid plastic.

4. The apparatus of claim 1 wherein said means for accelerating and launching includes means for preventing launching of an object smaller than said disc.

5. The apparatus of claim 4 wherein said means for preventing launching comprises a plurality of troughs, said troughs being recessed below said tracks, said troughs being aligned radially around the curve of said slot for impeding the acceleration of said object through said slot and for preventing launching of said object from said opening in said distal end of said head.

6. The apparatus of claim 4 wherein said means for accelerating and launching comprises first and second spaced walls defining said slot, each wall having a pair of tracks spaced apart and extending radially therealong.

7. The apparatus of claim 6 wherein said means for preventing launching comprises a trough extending below said tracks in said first wall and abutment means adjacent said trough for impeding the acceleration of and preventing the launching of said object from said opening in said distal end of said head.

8. The apparatus of claim 1 wherein said apparatus is formed of rigid planar material.

9. A disc launching toy device comprising:

(a) a disc;

(b) means for launching said disc comprising:

(1) a handle portion configured to be grasped by a user;

(2) an arcuate portion connected with one end of said handle portion and extending laterally and curvingly away therefrom, said arcuate portion comprising a curved first wall portion and second and third spaced wall portions extending radially inward from said first wall portion, said first, second and third wall portions defining therebetween a space configured to receive said disc therein;

said second wall portion having a trough therein adjacent said curved first portion and communicating with the space, said trough having a radial width less than the diameter of said disc, said trough receiving an object smaller than said disc when said object passes through said space in said arcuate portion, and said second wall portion having abutment means adjacent said trough for engaging said object and impeding the passage thereof through said space.

10. The apparatus of claim 9 wherein said arcuate portion having a radial inward wall covering the radial inward end of said space, said arcuate portion having a proximal and distal end and an opening in each of said ends communicating with said space, said proximal and distal openings being configured to permit the passage of the disc therethrough.

11. A disc launching toy device comprising:

(a) a handle:

(b) means engaging said handle for launching a disc comprising:

an arcuate portion connected with one end of said handle portion and extending laterally and curvingly away therefrom, said arcuate portion comprising a curved first wall portion and second and third spaced wall portions extending radially inward from said first wall portion, said first, second and third wall portions defining therebetween a space configured to receive said disc therein, said arcuate portion having a radial inward wall portion covering the radial inward end of said space, said arcuate portion having a proximal and distal end and an opening in each of said ends communicating with said space, said proximal and distal openings being configured to permit the passage of said disc therethrough.

12. The apparatus of claim 11 wherein said second and third wall portions each have a pair of tracks spaced apart and extending therealong.

13. The apparatus of claim 12 wherein said means for launching comprises means for preventing launching of an object smaller than said disc.

14. The apparatus of claim 13 wherein said means for preventing comprises a trough adjacent said track and extending below said second wall portion and an abutment means adjacent said trough for engaging said object and impeding the passage thereof through said space.

15. A hand-held disc launching apparatus comprising a handle and a head having a proximal end and a distal end, said handle being attached adjacent to said proximal end of said head, said head having means for accelerating and launching a disc of a predetermined size, said means for accelerating and launching having a curved slot therein which runs through said head from said proximal end to said distal end, said slot having an opening at both ends and having a cross-sectional shape to receive the disc in said opening in said proximal end of said head, said slot being configured so that launching of said disc from said opening in said distal end of said head is accompanied by acceleration of said disc through said slot by centrifugal force caused by said apparatus being swung forward by said handle, said means for accelerating and launching includes a first wall and a second opposite wall defining said slot and a pair of concentric semi-circular tracks of predetermined spacing on each wall of said slot.

16. The apparatus of claim 15 wherein said means for accelerating and launching includes means for preventing launching of an object smaller than said disc.

17. The apparatus of claim 16 wherein said means for preventing launching comprises a plurality of troughs, said troughs being recessed below said tracks, said troughs being aligned radially around the curve of said slot for impeding the acceleration of said object through said slot and for preventing launching of said object from said opening in said distal end of said head.

18. A hand-held disc launching apparatus comprising a handle and a head having a proximal end and a distal end, said handle being attached adjacent to said proximal end of said head, said head having means for accelerating and launching a disc of a predetermined size, said means for accelerating and launching having a curved slot therein which runs through said head from said proximal end to said distal end, said slot having an opening at both ends and having a cross-sectional shape to receive the disc in said opening in said proximal end of said head, said slot being configured so that launching of said disc from said opening in said distal end of said head is accompanied by acceleration of said disc through said slot by centrifugal force caused by said apparatus being swung forward by said handle, said means for accelerating and launching includes means for preventing launching of an object smaller than said disc.

19. The apparatus of claim 18 wherein said means for preventing launching comprises a plurality of troughs, said troughs being recessed below said tracks, said troughs being aligned radially around the curve of said slot for impeding the acceleration of said object through said slot and for preventing launching of said object from said opening in said distal end of said head.

* * * * *